US007681285B2

(12) United States Patent
Hua

(10) Patent No.: US 7,681,285 B2
(45) Date of Patent: Mar. 23, 2010

(54) DETACHABLE HANDLE MOUNTING STRUCTURE

(75) Inventor: Shan Su Hua, Taipei (TW)

(73) Assignee: Natura Innovation Ltd., Port Louis (MU)

( * ) Notice: Subject to any disclaimer, the term of this patent is extended or adjusted under 35 U.S.C. 154(b) by 716 days.

(21) Appl. No.: 11/522,333

(22) Filed: Sep. 18, 2006

(65) Prior Publication Data

US 2008/0078066 A1 Apr. 3, 2008

(51) Int. Cl.
*A45C 13/26* (2006.01)

(52) U.S. Cl. ..... 16/422

(58) Field of Classification Search ..... 16/114.1, 16/113.1, 405, 429, 422; 190/115, 18 R, 190/18 A; 403/93, 101, 103, 300, 309, 361, 403/377, 373, 345, 324; 280/47.315, 47.371, 280/655; 294/49, 51, 52, 53.5, 55, 57; 30/277, 30/526, 532; 81/177.1, 489; 15/144.1, 144.3, 15/144.4

See application file for complete search history.

(56) References Cited

U.S. PATENT DOCUMENTS 3,049,367 A * 8/1962 Lashta ..... 285/7
3,924,775 A * 12/1975 Andreaggi et al. ..... 220/756
5,220,707 A * 6/1993 Newman et al. ..... 16/429
5,682,641 A * 11/1997 Newman et al. ..... 16/429
5,729,865 A * 3/1998 Stoddart ..... 16/429
5,910,105 A * 6/1999 Swain et al. ..... 600/131
6,532,630 B1 * 3/2003 Newman et al. ..... 16/429
6,546,596 B2 * 4/2003 Grote et al. ..... 16/429
6,883,208 B1 * 4/2005 Huang ..... 16/429
6,938,521 B1 * 9/2005 Skeens ..... 81/60
7,278,668 B1 * 10/2007 Simmons ..... 294/25

* cited by examiner

*Primary Examiner*—Chuck Y. Mah
(74) *Attorney, Agent, or Firm*—Birch, Stewart, Kolasch & Birch, LLP

(57) ABSTRACT

A detachable handle mounting structure includes a handle, a sleeve fixedly provided at one end of the handle for receiving a tool, a socket, which is fixedly provided at a recessed portion on the periphery of the sleeve and has an accommodation open chamber and a bottom center hole cut through the periphery wall of the sleeve, a plug partially inserted into the bottom center hole of the socket and vertically movable in the bottom center hole of the socket between a locking position where the plug is partially projecting into the inside of the sleeve to lock a tool to the sleeve and an unlocking position where the plug is moved away from the inside of the sleeve to unlock the tool that is inserted into the sleeve, and a rotary knob, which has a coupling member coupled to the plug and is rotatable to move the plug vertically in the bottom center hole of the socket between the locking position and the unlocking position.

8 Claims, 7 Drawing Sheets

DETACHABLE HANDLE MOUNTING STRUCTURE

BACKGROUND OF THE INVENTION

1. Field of the Invention

The present invention relates to garden tools and more particularly, to a detachable handle mounting structure for garden tool that detachably connects a handle to a tool. The handle can be made in the form of a long shaft for the holding of the both hands, or a short grip for the holding of one single hand.

2. Description of the Related Art

Draw hoe, pruning saw, trowel, and other garden tools may be selectively used for cultivation of the soil. These garden tools commonly have a fixed handle. It is inconvenient to carry a set of garden tools. Further, because conventional garden tools do not have a detachable handle, they require a big amount of packing materials and occupy much space during delivery. Further, the supplier or distributor must provide a big place to display or store garden tools.

SUMMARY OF THE INVENTION

The present invention has been accomplished under the circumstances in view. It is one object of the present invention to provide a detachable handle mounting structure, which enables the handle to be detachably connected to any of a variety of tools. It is another object of the present invention to provide a detachable handle mounting structure, which locks the handle to be locked or unlocked by means of rotary motion within 90°. It is another object of the present invention to provide a detachable handle mounting structure, which enables the user to accurately and easily attach the handle to any of a variety of tools.

To achieve these and other objects of the present invention, the detachable handle mounting structure comprises a handle; a sleeve fixedly connected to one end of the handle for receiving a tool, the sleeve having a recessed portion on the periphery thereof and a socket fixedly provided at the recessed portion, the socket having an accommodation open chamber and a bottom center hole cut through the periphery wall of the sleeve at the center of the accommodation open chamber; a plug partially inserted into the bottom center hole of the socket and vertically movable in the bottom center hole of the socket between a locking position where the plug is partially projecting into the inside of the sleeve to lock a tool to the sleeve and an unlocking position where the plug is moved away from the inside of the sleeve to unlock the tool that is inserted into the sleeve; and a rotary knob, the rotary knob comprising a knob body coupled to the socket and rotatable relative to the socket to move the plug vertically in the bottom center hole of the socket between the locking position and the unlocking position, the knob body having an open chamber, a coupling member suspending in the open chamber of the knob body and coupled to the plug.

DETAILED DESCRIPTION OF THE PREFERRED EMBODIMENT

Figure 1:
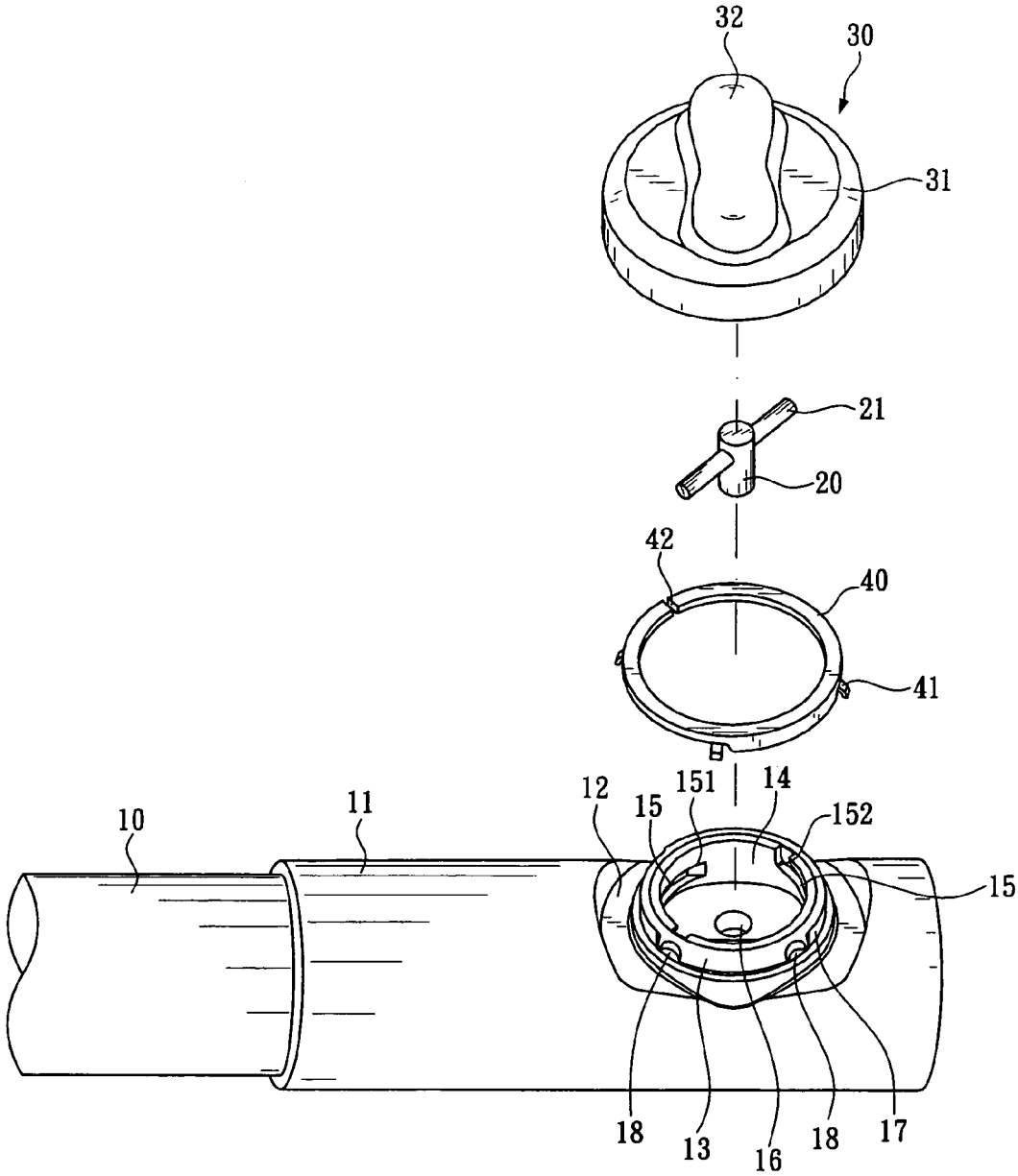
FIG. 1 is an exploded view of a detachable handle mounting structure according to the present invention (the connecting bar and the tool excluded).
Figure 2:
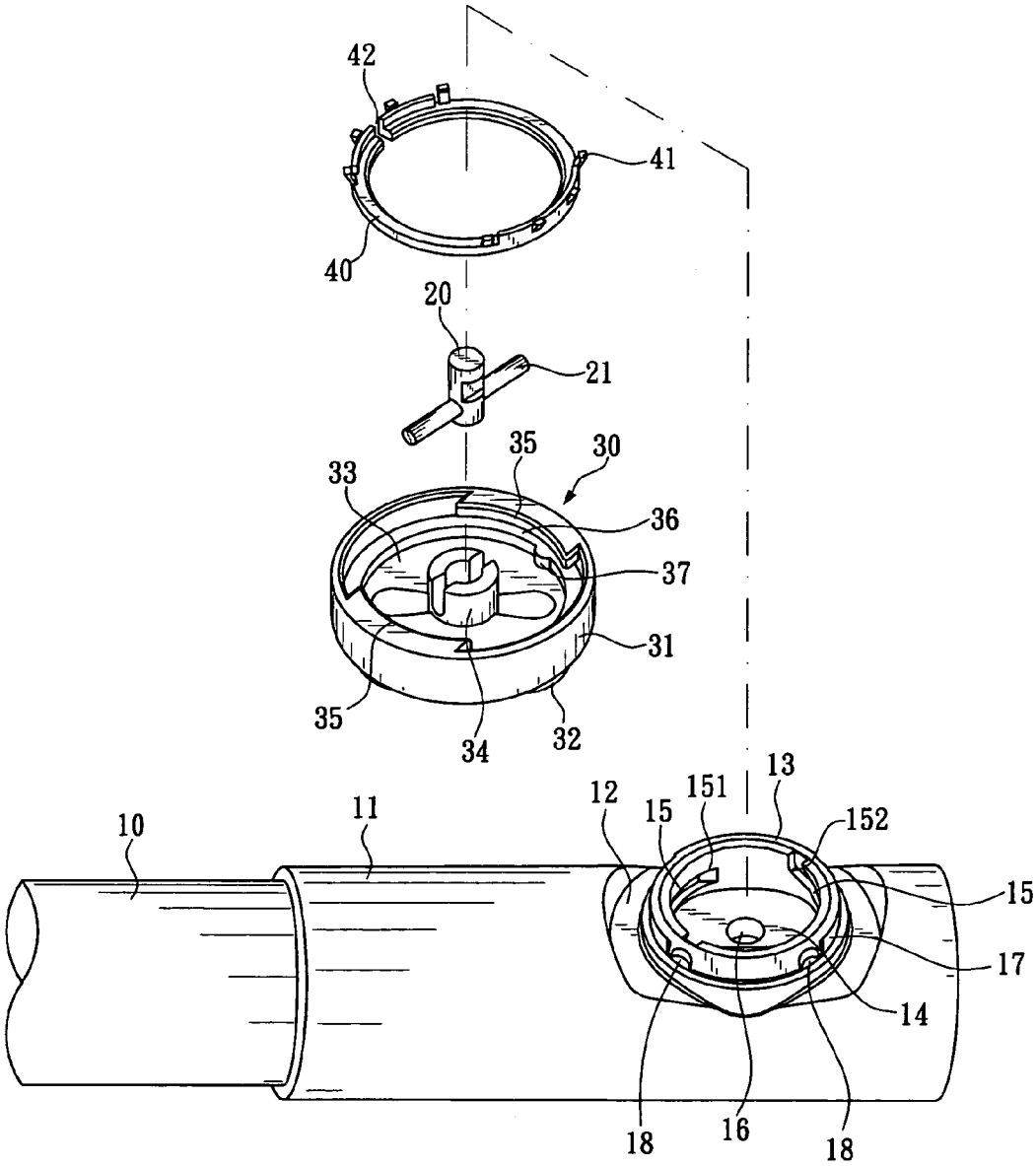
FIG. 2 corresponds to FIG. 1, showing the retaining ring, the plug and the rotary knob turned upside down.
Figure 3:
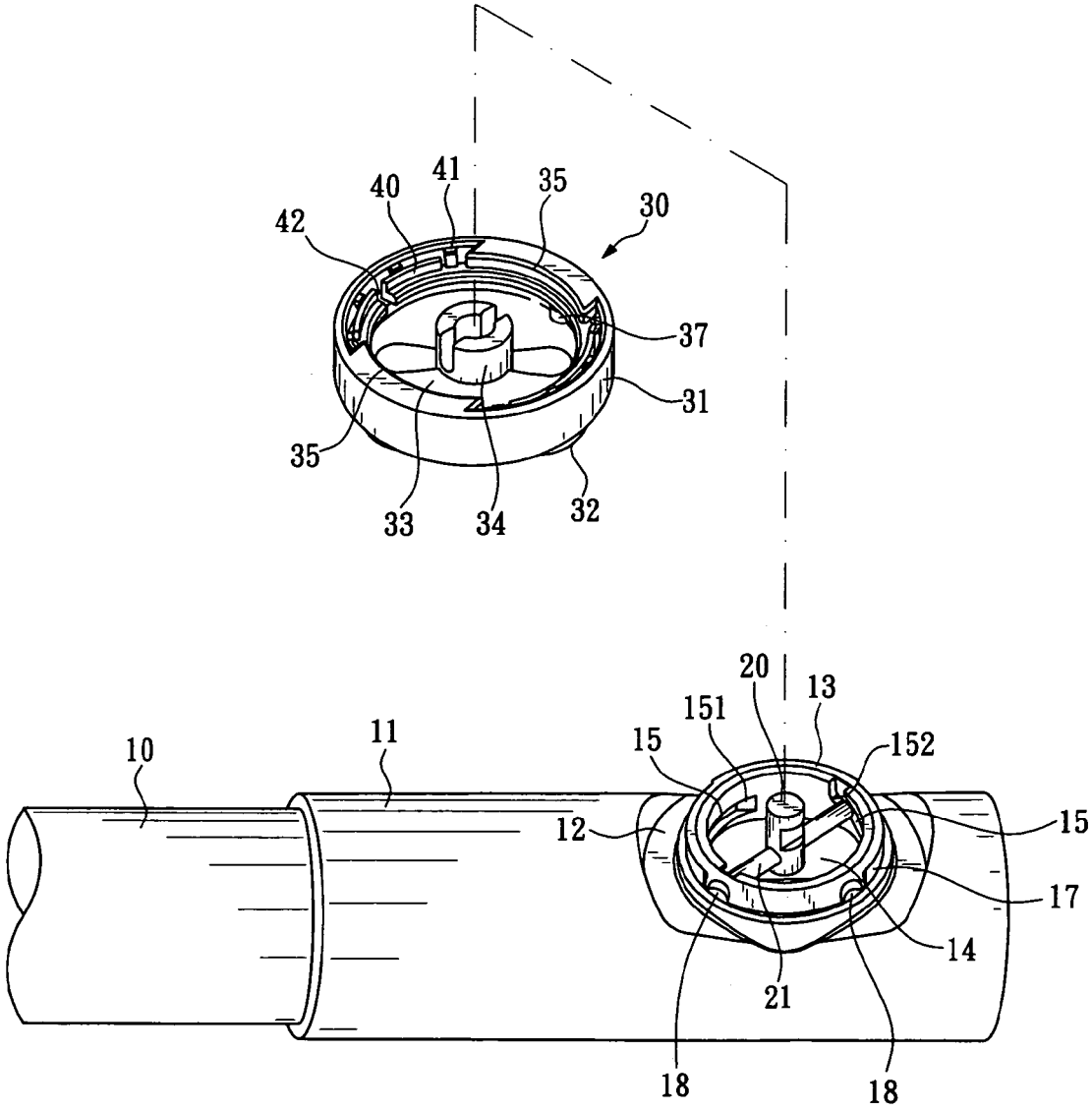
FIG. 3 corresponds to FIG. 2, showing the retaining ring fastened to the rotary knob and the plug fastened to the socket.
Figure 4:
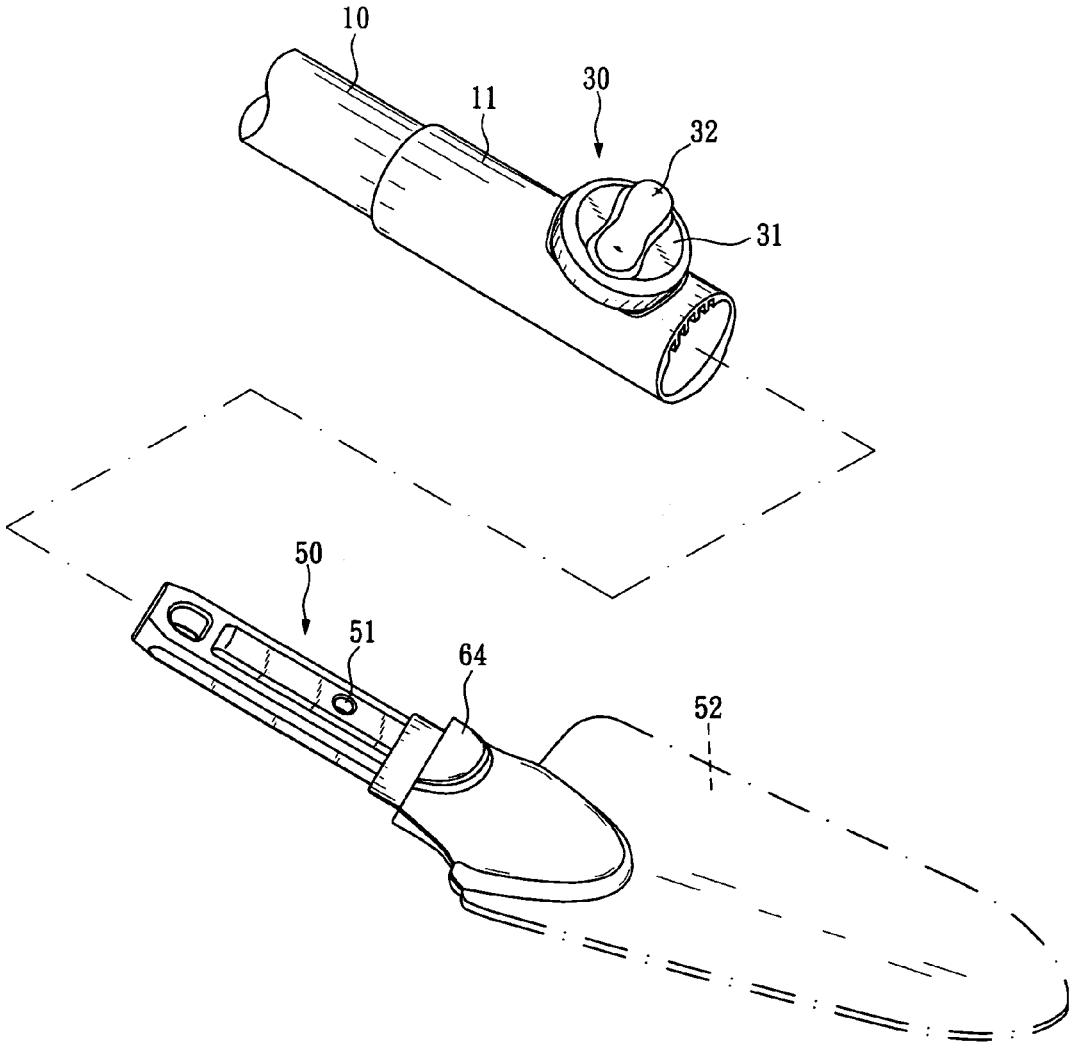
FIG. 4 shows the detachable handle mounting structure assembled before connection to the connecting bar at the tool.
Figure 5:
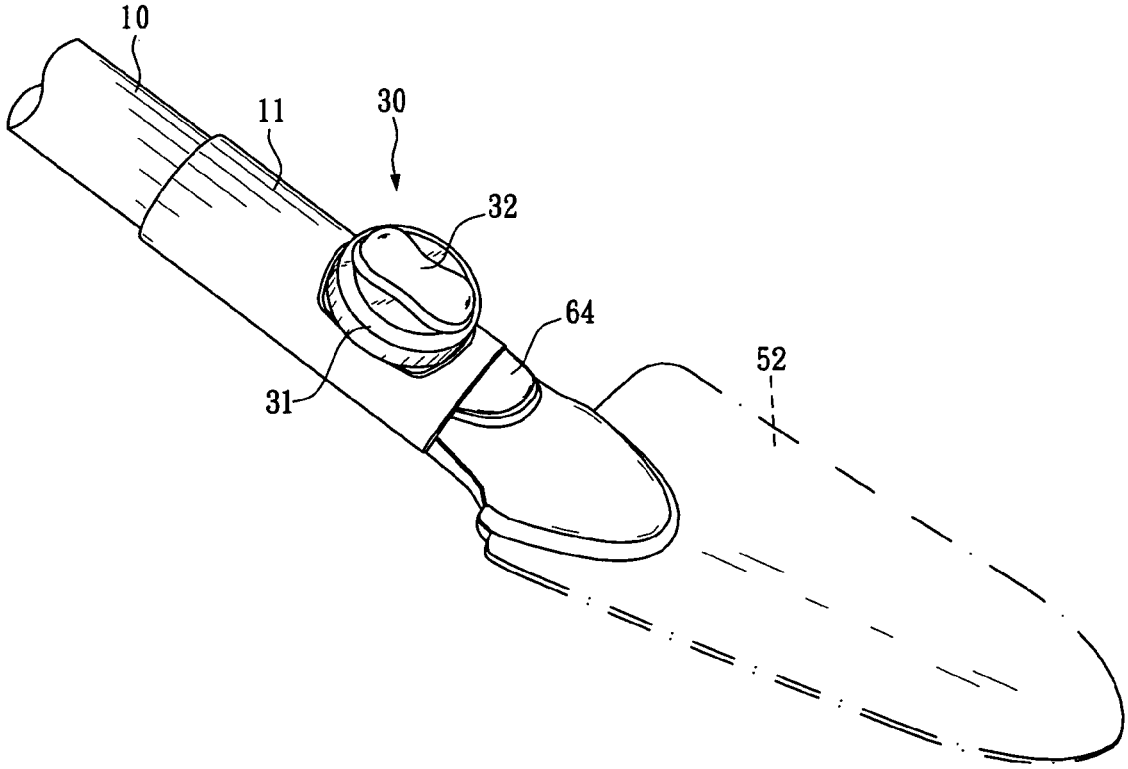
FIG. 5 is an assembly view of FIG. 4.

Referring to FIGS. 1~5, a detachable handle mounting structure in accordance with the present invention is generally comprised of a metal handle 10, a socket 13, a plug 20, a rotary knob 30, a retaining ring 40, and a connecting bar 50.

The metal handle 10 has a plastic sleeve 11 fixedly provided at one end thereof. The plastic sleeve 11 has a recessed portion 12 on the periphery.

The socket 13 is an annular member fixedly provided at the recessed portion 12 of the plastic sleeve 11, having an accommodation open chamber 14 and two spiral guide grooves 15 formed on the inside wall thereof within the accommodation open chamber 14 and spaced from each other at 180°. Each spiral guide groove 15 has a lower end 151 and an upper end 152. The socket 13 further has a bottom center hole 16, which extends through the peripheral wall of the plastic sleeve 11, a locating groove 17 on the outside wall, and two recesses 18 on the top edge corresponding to the lower end 151 of one spiral guide groove 15 and the upper end 152 of the other spiral guide groove 15.

The plug 20 is mounted in the bottom center hole 16 inside the accommodation open chamber 14 of the socket 13, having a cross rod 21. The cross rod 21 has the two distal ends thereof respectively inserted into the spiral guide grooves 15. The cross rod 21 can be rotated and moved along the spiral guide grooves 15 between the respective lower ends 151 and the respective upper ends 152. When the ends of the cross rod 21 are moved toward the respective lower ends 151 of the spiral guide grooves 15, the plug 20 is lowered toward the inside of the plastic sleeve 11. On the contrary, when the ends of the cross rod 21 are moved away from the respective lower ends 151 of the spiral guide grooves 15 toward the respective upper ends 152, the plug 20 is moved in the reversed direction toward the outside of the plastic sleeve 11.

The rotary knob 30 is adapted to move the plug 20, having a knob body 31 and a finger block 32. The finger block 32 is fixedly provided at the top side of the knob body 31. The knob body 31 is coupled to the socket 13 at the recessed portion 12 of the plastic sleeve 11. Through the finger block 32, the user can rotate the rotary knob 30 to the desired angle conveniently with the fingers. The knob body 31 has an open chamber 33, a coupling member 34 suspending in the open chamber 33 at the center and coupled to the plug 20 and the cross rod 21, two stop flanges 35 protruded from the inside wall within the open chamber 33 and spaced from each other at 180°, an inside annular groove 36 defined between the stop flanges 35 and the bottom wall of the open chamber 33, and two locating blocks 37 protruded from the inside wall and suspending in the open chamber 33. When the rotary knob 30 is rotated clockwise or counter-clockwise through 90°, one locating block 37 is engaged into one recess 18.

The retaining ring 40 is a split ring set in the inside annular groove 36 of the rotary knob 30, having an opening 42 and a plurality of springy radial teeth 41 respectively stopped at the ends of the stop flanges 35 to prohibit rotation of the retaining ring 40 relative to the rotary knob 30 and to have the retaining ring 40 be rotated with the rotary knob 30. When the coupling member 34 of the rotary knob 30 is coupled to the plug 20 and the cross rod 21, the retaining ring 40 is forced by the socket 13 to expand and to move over the outside wall of the socket 13 toward the locating groove 17. When reached the locating groove 17, the retaining ring 40 returns to its former shape and engaged into the locating groove 17, thereby securing the rotary knob 30 to the socket 13 and allowing rotation of the rotary knob 30 relative to the socket 13.

The connecting bar 50 is formed integral with one side of a tool 50 and inserted into the plastic sleeve 11, having a plug hole 51 for receiving the plug 20 and a stop block 64 stopped against the free end of the plastic sleeve 11.

Figure 6:
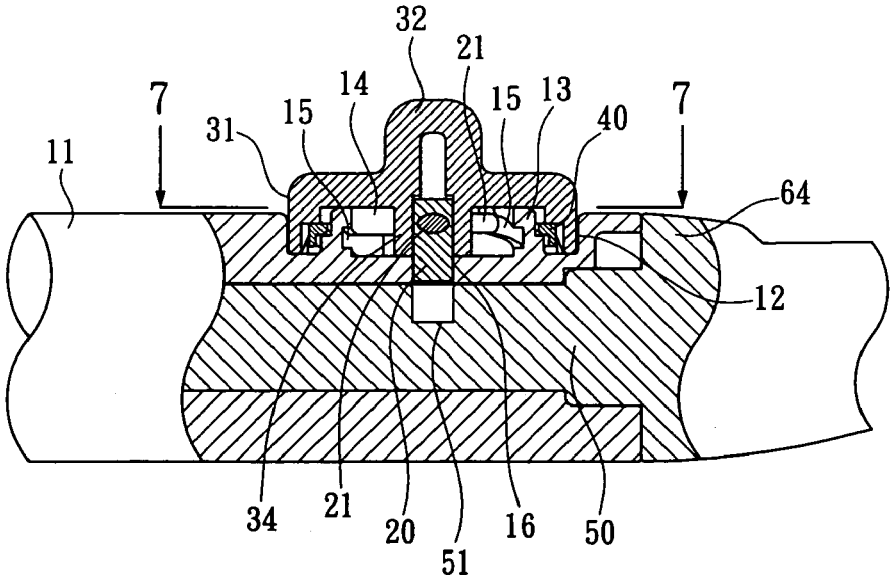
FIG. 6 is a sectional view of the present invention, showing the plug kept in the unlocking position.
Figure 7:
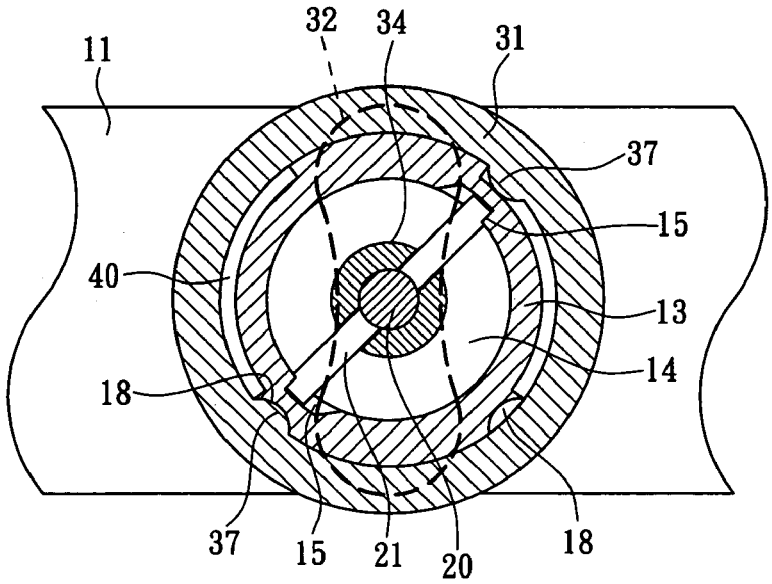
FIG. 7 is a sectional view taken along line 7-7 of FIG. 6

Referring to FIGS. 6 and 7, when rotated the rotary knob 30 to the position where the ends of the cross rod 21 are respectively stopped at the respective upper ends 152, the plug 20 is kept away from the plug hole 51 of the connecting bar 50, and therefore the connecting bar 50 is unlocked and can be moved with the tool 50 away from the plastic sleeve 11. At this time, one locating block 37 is kept engaged in one recess 18, holding the rotary knob 30 in the unlocking position.

Figure 8:
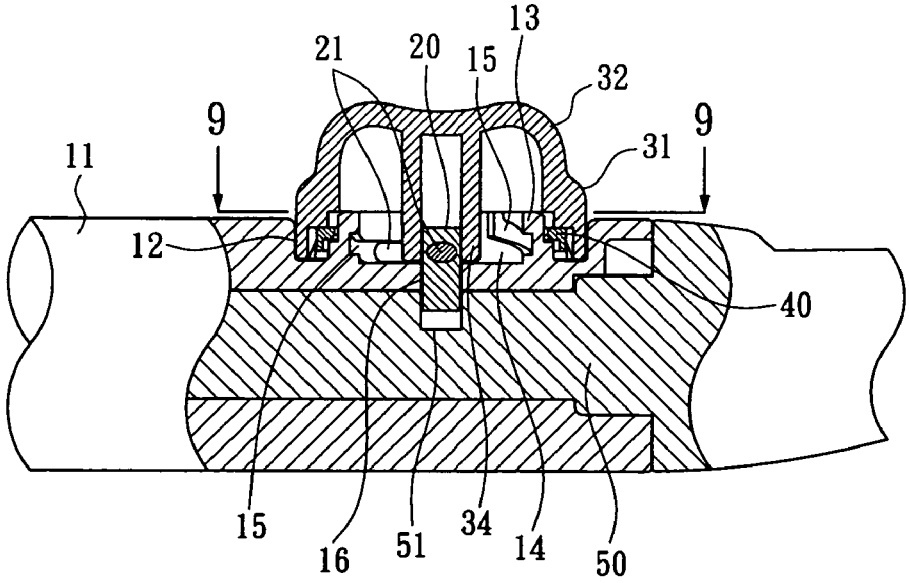
FIG. 8 corresponds to FIG. 6, showing the plug moved to the locking position.
Figure 9:
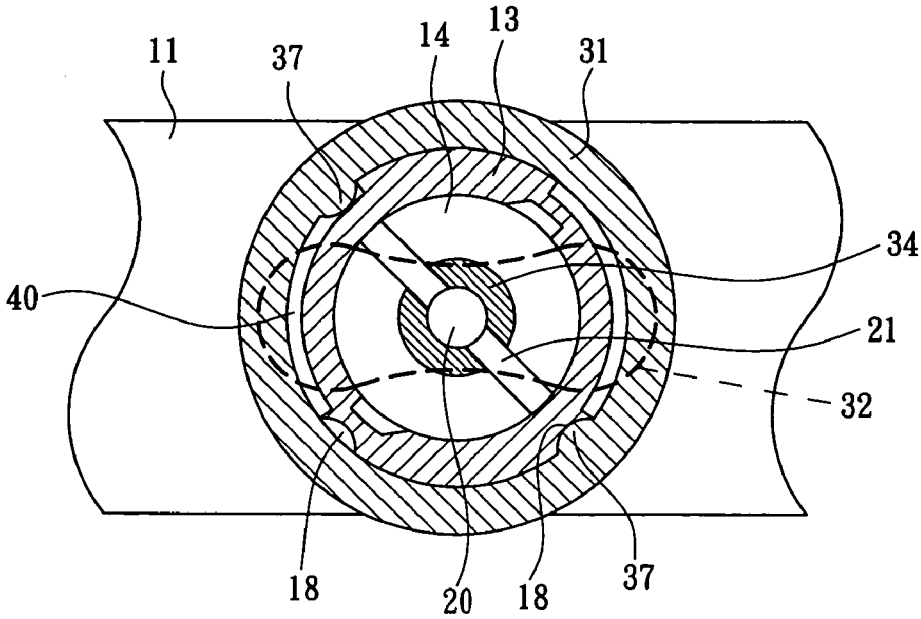
FIG. 9 is a sectional view taken along line 9-9 of FIG. 8.

Referring to FIGS. 8 and 9, when rotated the rotary knob 30 to the position where the ends of the cross rod 21 are respectively stopped at the respective lower ends 151, the plug 20 is engaged into the plug hole 51 of the connecting bar 50 to lock the connecting bar 50 to the plastic sleeve 11. At this time, one locating block 37 is kept engaged in the other recess 18, holding the rotary knob 30 in the locking position.

A prototype of detachable handle mounting structure has been constructed with the features of FIGS. 1~9. The detachable handle mounting structure functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A detachable handle mounting structure comprising:

a handle;

a sleeve fixedly connected to one end of said handle for receiving a tool, said sleeve having a recessed portion on the periphery thereof and a socket fixedly provided at said recessed portion, said socket having an accommodation open chamber and a bottom center hole cut through the periphery wall of said sleeve at the center of said accommodation open chamber;

a plug partially inserted into the bottom center hole of said socket and vertically movable in the bottom center hole of said socket between a locking position where said plug is partially projecting into the inside of said sleeve to lock a tool to said sleeve and an unlocking position where said plug is moved away from the inside of said sleeve to unlock the tool that is inserted into said sleeve; and a rotary knob, said rotary knob comprising a knob body coupled to said socket and rotatable relative to said socket to move said plug vertically in the bottom center hole of said socket between said locking position and said unlocking position, said knob body having an open chamber, a coupling member suspending in the open chamber of said knob body and coupled to said plug, wherein said socket has at least one spiral guide groove, said at least one spiral guide groove each having a lower end and an upper end, said plug having a guide rod movable along said at least one spiral guide groove between the lower end and upper end of each of said at least one spiral guide groove to move said plug vertically in said bottom center hole of said socket during a rotary motion of said rotary knob.

2. The detachable handle mounting structure as claimed in claim 1, wherein said socket has two spiral guide grooves formed on an inside wall thereof and spaced from each other at 180°, said guide rod having two distal ends respectively inserted into said spiral guide grooves.

3. The detachable handle mounting structure as claimed in claim 1, wherein said rotary knob has a finger block fixedly provided at a top side of said knob body.

4. The detachable handle mounting structure as claimed in claim 3, wherein said knob body of said rotary knob has an inside annular groove, wherein said socket has a locating groove on the periphery thereof, wherein a retaining ring is internally engaged into the locating groove of said socket and externally engaged into the inside annular groove of said knob body of said rotary knob.

5. The detachable handle mounting structure as claimed in claim 4, wherein said retaining ring is a split ring having an opening.

6. The detachable handle mounting structure as claimed in claim 4, wherein said retaining ring has a plurality of springy radial teeth respectively stopped against said knob body.

7. The detachable handle mounting structure as claimed in claim 1, wherein said socket has at least one recess on an outside wall thereof; said knob body of said rotary knob has at least one inside locating block for engaging said at least one recess of said socket.

8. The detachable handle mounting structure as claimed in claim 1, wherein said socket has two recesses on an outside wall thereof; said knob body of said rotary knob has two inside locating blocks, wherein one of said locating blocks is engaged into one of said two recesses when said rotary knob is rotated relative to said socket in one of two reversed directions to a predetermined angle.

* * * * *